US005340114A

United States Patent [19]

Wester

[11] Patent Number: 5,340,114

[45] Date of Patent: Aug. 23, 1994

[54] CHECKER BOTTOM SINGLE, DUAL, OR TRIPLE INDICATOR

[76] Inventor: Dan Wester, 2251 Fort Worth Hwy., Weatherford, Tex. 76087

[21] Appl. No.: 56,182

[22] Filed: May 3, 1993

[51] Int. Cl.[5] ..... A63F 3/02

[52] U.S. Cl. ..... 273/260; 273/288; 273/291

[58] Field of Search ..... 273/260, 261, 288, 290, 273/291

[56] References Cited

U.S. PATENT DOCUMENTS

| | | | |
|---|---|---|---|
| 738,701 | 9/1903 | Sauer | 273/291 |
| 1,204,006 | 11/1916 | Goldmerstein | 273/291 |
| 2,355,927 | 8/1944 | Scofield | 273/291 X |
| 3,791,648 | 2/1974 | Patterson | 273/291 X |
| 3,904,206 | 9/1975 | Kolwicz . | |
| 4,019,746 | 4/1977 | Hare . | |
| 4,037,843 | 7/1977 | Hoffman . | |
| 4,136,880 | 1/1979 | Rikon . | |
| 4,300,768 | 11/1981 | Wechsler . | |
| 4,343,476 | 8/1982 | Engel . | |
| 4,580,787 | 4/1986 | Baker . | |
| 4,634,129 | 1/1987 | Martinez . | |
| 5,116,062 | 5/1992 | Johnson | 273/291 X |
| 5,149,102 | 9/1992 | McGowan et al. | 273/291 X |

FOREIGN PATENT DOCUMENTS

| | | | |
|---|---|---|---|
| 8244 | of 1906 | United Kingdom | 273/291 |

*Primary Examiner*—William E. Stoll

*Attorney, Agent, or Firm*—Geoffrey A. Mantooth

[57] ABSTRACT

The game of the present invention includes a traditional checkerboard (44) and two sets of checkers. Each set includes 15 dark (12) checkers and 15 light (16) checkers. Each set includes 5 single indicator bottoms (4), 5 dual indicator bottoms (28), and 5 triple indicator bottoms (40). Movement of checkers depends on type of indicator bottom: single indicator bottom (4) means lose your turn, dual indicator bottom (28) means play normally, and triple indicator bottom (40) means remove jumping checker from checkerboard (44). Alternate turns are taken by both players advancing diagonally forward one square at a time, trying to avoid capture by the opponent until reaching the opposite end of the checkerboard (44).

7 Claims, 4 Drawing Sheets

CHECKER BOTTOM SINGLE, DUAL, OR TRIPLE INDICATOR

BACKGROUND

1. Field of Invention

This invention relates to the original checker game, specifically to a unique addition to the checker apparatus bottom and game rules.

2. Description of Prior Art

Toy stores and department stores handle the original checker game. The original checker game offers great simplicity for all players, both young and old; however players crave creativity in playing this game.

In order to compensate for this simplicity, many versions of the original checker game have been introduced and patented, trying to offer variety to this game. U.S. Pat. No. 4,634,129 to Jorge Martinez discloses a color correlated game board which varies from the original checker game. However, it presents confusion for the child in determining checker moves on this type of board. U.S. Pat. No. 4,580,787 to Robert D. Baker presents a variety to this game. modified chess game using hexagonal shapes. However, the 217 hexagonal spaces creates a congested game board. U.S. Pat. No. 4,343,476 to Robert W. Engel relays a game piece for the checker game; however, this piece presents a hazard to children. U.S. Pat. No. 4,136,880 to Eli Rikon utilizes four sets of checkers; however, this version also limits itself to a mature player, thus eliminating the child population. U.S. Pat. No. 4,037,843 to Alfred J. Hoffman shows an advanced game of checkers, yet this game would limit the audience to mature players, as well. U.S. Pat. No. 4,019,746 to Herbert K. Hare varies the checker piece by adding a piggy-back cavity, but it doesn't vary the challenge of the checker game itself. U.S. Pat. No. 3,904,206 issued to Stanley J. Kolwicz offers expansion of the game to four persons by utilizing an upright game board; however, it would be difficult and confusing to play two consecutive games of checkers at once.

OBJECTS AND ADVANTAGES

Accordingly, several objects and advantages of my invention utilizing single, dual, or triple indicator checkers include:

(a) These game pieces and rules can be used with the original checker board, thus making production of this game economical.

(b) The checker apparatus is easily drilled or molded (depending on material chosen), allowing easy access to fit and glue the doll's eyes into the checker.

(c) The checkers can be sent without a game board if purchaser so chooses, thus decreasing the cost to said purchaser.

(d) Due to the lightweight materials used in manufacture, shipping cost is minimal.

(e) Simple directions with illustrations of the checker bottoms and corresponding movements of checkers allow both children and adults to play.

(f) Game provides a challenging and innovative game to promote more interest and memory exercise beyond other checker games.

(g) Game combines competition and skill, coupled with the excitement of chance as an equalizer.

(h) The name 'Chancing Checkers' gives players the illusion of chance and competition.

(i) My eye-catching checker apparatus sparks great interest in a relatively simple and familiar game for both adults and children.

(j) My checker apparatus provides a feeling of 'eyes' looking at the player when picked up to jump opponent.

(k) My game builds memory skill and strategic thinking processes which in turn creates 'fun' educational value for children.

(l) The option of black and white or dark and light checker board with dark and light checkers or opposite vivid color checkers gives the players a feeling of a 'race to the finish,' as in a car race.

(m) My game offers the challenge of shuffling and randomly selecting 12 out of 15 checkers by each player knowing the type of checker bottom (single, dual, or triple indicator).

(n) My game creates more mystery when a checker is 'kinged,' as the checker chosen to king with is randomly selected, as well.

(o) Both players see the bottom of the jumping checker and both players know what kind of play it can or cannot make; thus providing memory skill and strategic manipulation to improve the challenge and competition of the game.

(p) The anticipated winning player can suddenly lose the game in the last moments of the game by having the 'wrong' kinged checker or the 'wrong' single checkers remaining on the board.

(q) My game rules can vary:

(1) Each player can selectively pick the type of checker and strategically place it on the game board.

(2) This variation creates a 'bluffing' element which adds to the game's excitement.

DRAWING FIGURES

Figure 4:
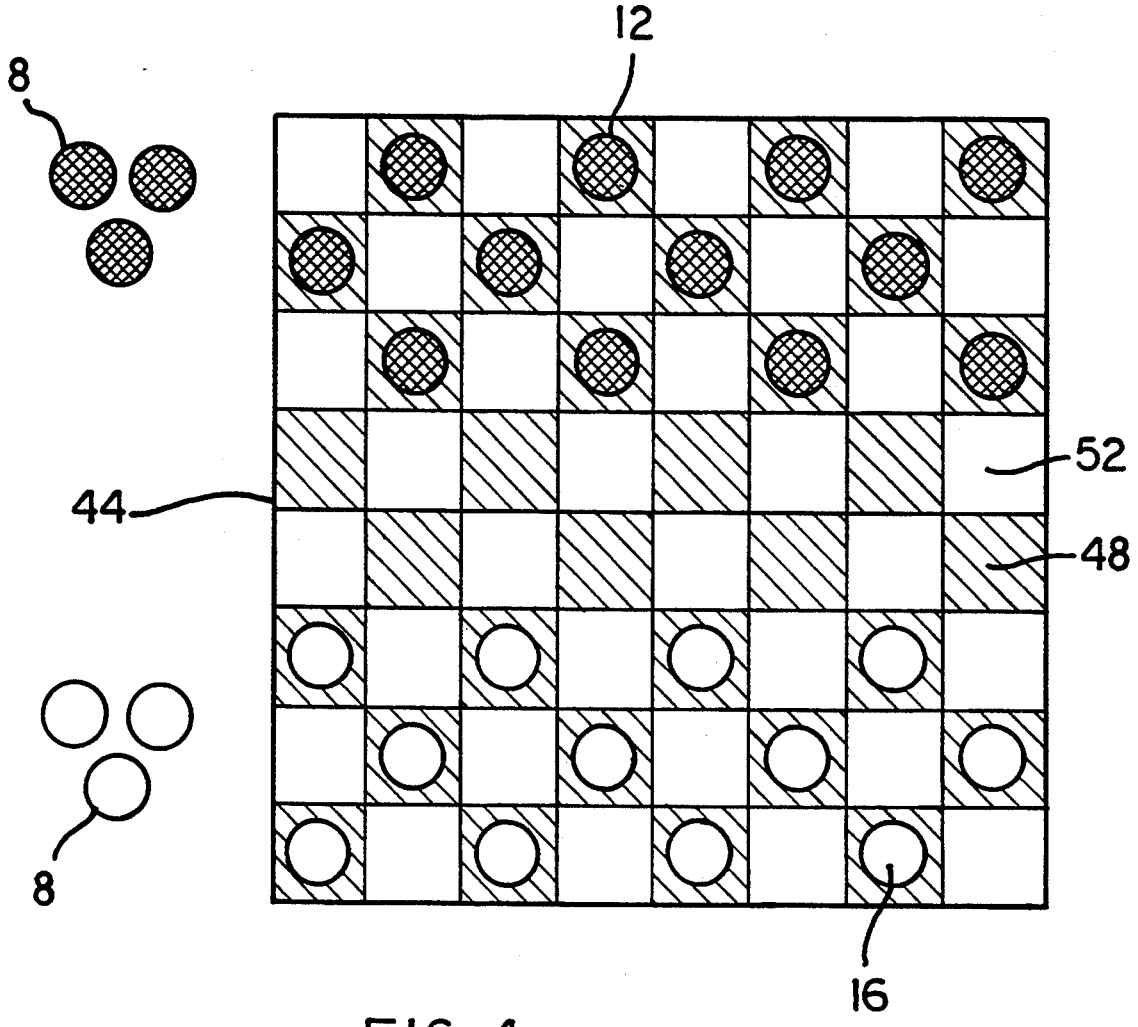

FIG. 4 shows the correct placement of the checkers from the top view at the beginning of the game. Only 12 of the 15 checkers are randomly selected. The other 3 checkers are laid aside (face down) and shuffled for 'kinging' other checkers later in the game. This drawing also illustrates the diagonal movement of the checkers.

Figure 5:
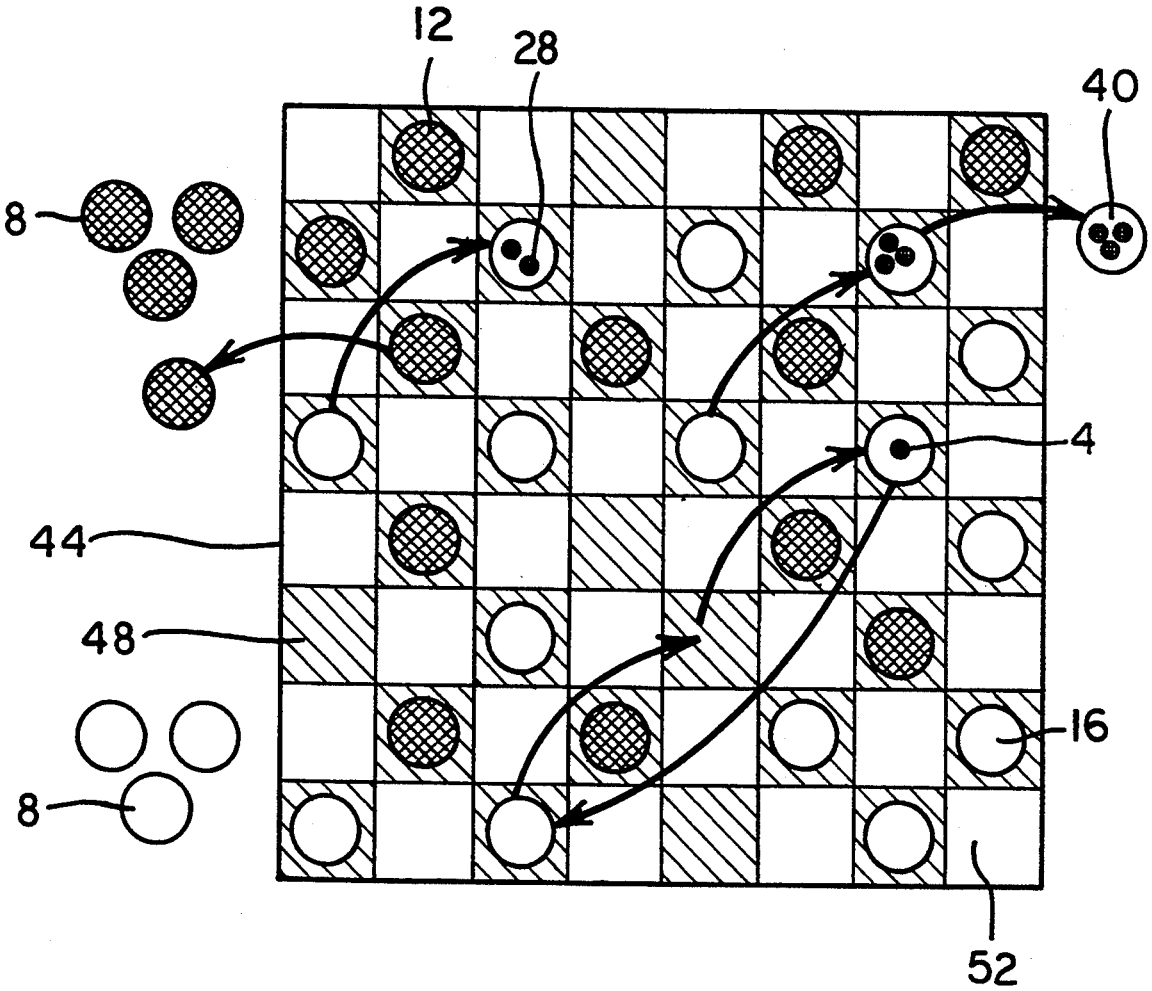

FIG. 5 shows the three playing moves of the single, dual, and triple indicator checkers. As illustrated, the single-indicator checker 'loses its turn,' thus returning to its original position without taking the checker it tried to jump. The dual-indicator checker 'can jump,' thus taking the jumped checker as in the original checker game. The triple-indicator checker 'is removed from the game board,' and doesn't get the jumped checker. The illustrated single-indicator checker demonstrates the frustration of securing a 'dougle-jump,' turning over the checker only to find a single-indicator and having to return the single-indicator checker to its original position.

Figure 6:
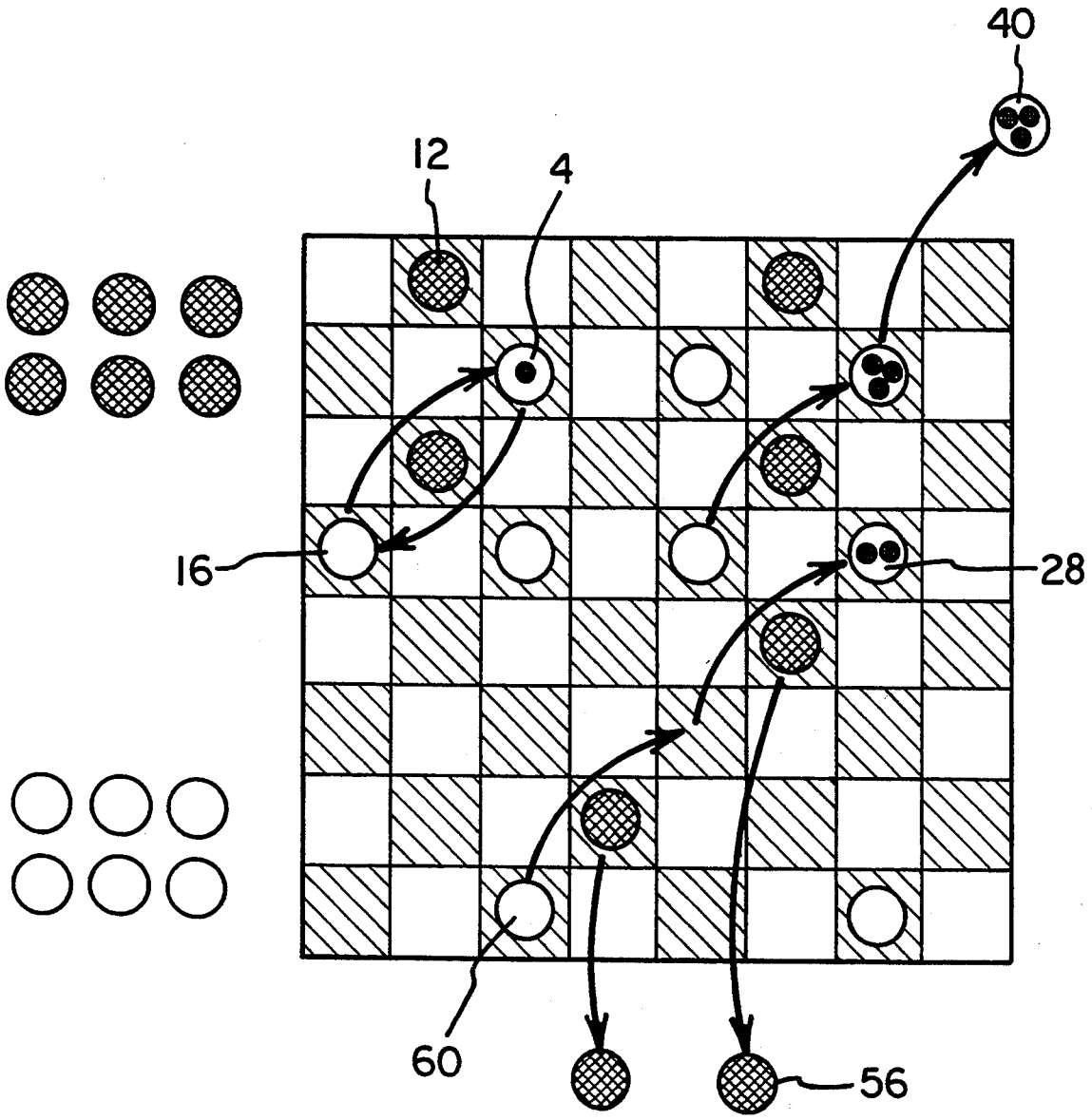

FIG. 6 shows the three playing moves of 'kinged' single, dual, and triple-indicator checkers. As illustrated, the moves are identical to FIG. 5 with the exception that the player deals with 'kinged' checkers, thus greatly increasing the stakes of the game. The dual-indicator kinged checker illustrates a great turn in the game (this game was nearly equal in outcome of winner) by taking off a single and kinged checker from the opponent's side. This type of action creates a mystery of a 'winner outcome' up to the final moments of the game.

REFERENCE NUMERALS IN DRAWINGS

4 single-indicator checker bottom
8 top of checker
12 dark top of checker
16 light top of checker
20 side of checker
24 painted pink flesh
28 dual-indicator checker bottom
32 dome eyeball of checker bottom
36 moveable pupil of checker bottom
40 triple-indicator checker bottom
44 checkerboard square
48 dark checkerboard square
52 light checkerboard square
56 top of 'dark' kinged checker
60 top of 'light' kinged checker

DESCRIPTION—FIGURES 1-6

The game of the present invention includes a checker-shown generally in FIGS. 4-6 (44). This checkerboard consists of 64 equally sized square areas with 32 dark checkerboard squares (48) and 32 light checkerboard squares (52). The playing field consists of eight rows and eight columns with alternate light (52) and dark (48) squares. The printed checkerboard pattern is glued to the top surface of an equally sized piece of 1/16" cardboard which folds in the center.

The game further comprises 30 checkers, consisting of 15 dark (12) checkers and 15 light (16) checkers. Each checker is made of wood with approximate dimensions ¼" deep and 1" diameter. The checkers are arranged on the checkerboard (44) on the dark squares (48). Each checker has diagonal movement only (refer to FIG. 4).

Figure 1:
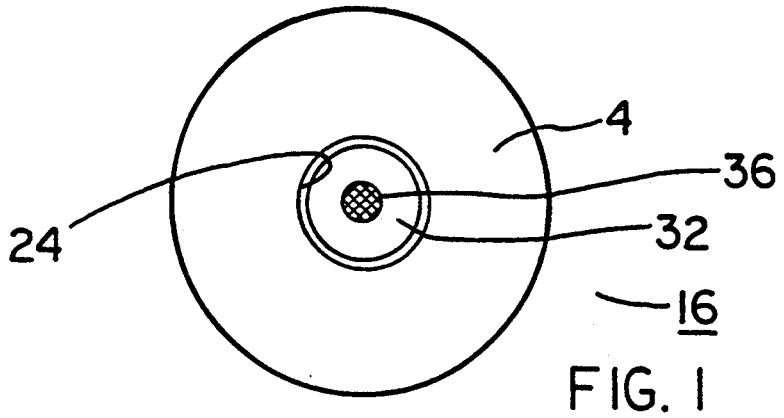
FIG. 1 shows a three-dimensional (top, side, bottom) view of the single-indicator checker with the doll's eye being centered.

The single-indicator is positioned in the center bottom (4) of the checker; (refer to FIG. 1) approximately ½" from the top edge of the checker bottom (4). a ⅜" drill bit affixed to a drill press chuck drills a single hole approximately 3/16" deep×¼" diameter into the bottom (4) of the checker. A ¼" (approximate) doll's eye with dome eyeball (32) and moveable pupil (36) is glued into the bottom of the 3/16"×¼" drilled hole on the bottom of checker (4). The rough edges of the drilled hole are sanded with fine sandpaper and pink flesh color is painted (24) around the inner edge, giving the appearance of a real eye looking at the player. The doll's eye lies flush with the bottom of the drilled hole located in the center of the bottom of the single-indicator checker (4). There are five dark (12) single-indicator checkers (4)—one set for each player.

Figure 2:
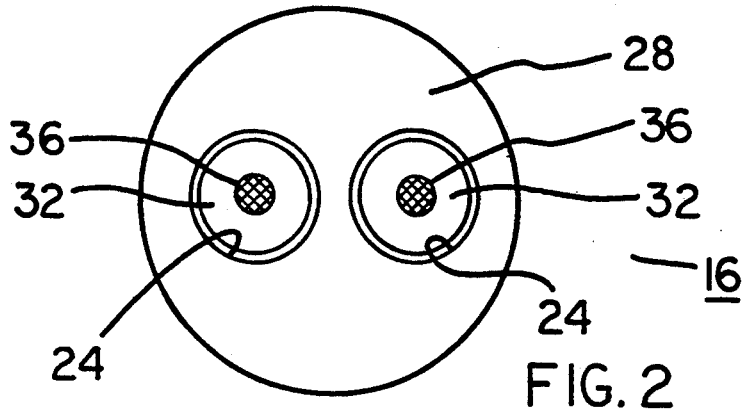
FIG. 2 shows a three-dimensional view (top, side, bottom) view of the dual-indicator checker with the 'moveable doll's eyes' being centered. It gives the appearance of 'two eyes' watching the player.

The dual-indicator is positioned in the center bottom (28) of the checker (refer to FIG. 2). A ⅜" drill bit affixed to a drill press chuck drills two holes approximately 3/16"×¼" diameter on the bottom (28) of the checker with the center of each hole ½" from the top edge of the checker bottom. The two holes are ⅛" apart from one another and centered on dual-indicator checker (28). An approximate ¼" doll's eye with dome eyeball (32) and moveable pupil (36) is glued into the bottom of checker (28). The rough edges of the drilled holes are sanded with fine sandpaper and pink flesh color is painted (24) around the inner edge of each hole, giving the appearance of two real eyes looking at the player. The two doll's eyes lie flush with the bottom of the two drilled holes located in the center of the bottom of the dual-indicator checker (28) with holes ⅛" apart. There are five dark (12) dual-indicator checkers (28) and five light (16) dual-indicator checkers (28)—one set for each player.

Figure 3:
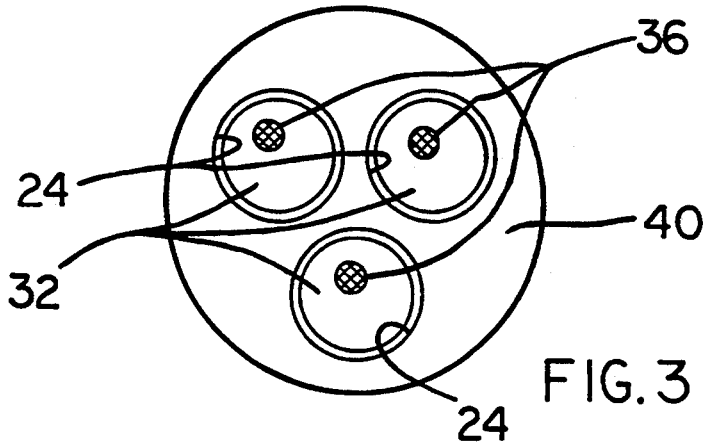
FIG. 3 shows a three-dimensional )top, side, bottom) view of the triple-indicator checker with the three 'moveable doll's eyes' being centered. It gives the appearance of 'three eyes' watching the player.

The triple-indicator is positioned approximately ¼" from top edge of checker bottom (40) with top two eyes ⅛" apart and third eye centered ⅛" below top two eyes (refer to FIG. 3). A ⅜" drill bit affixed to a drill press chuck drills the three holes 3/16" deep ×¼" diameter on bottom (40) of the checker. The top two holes are ¼" from top edge of checker bottom (40) with ⅛" wide distance between the two holes. The third hole is drilled ⅛" below top two holes (centered below top two holes). The rough edges of the drilled holes are sanded with fine sandpaper and pink flesh color is painted (24) around the inner edge of each hole, giving the appearance of two real eyes looking at the player, with the additional feature of a mouth which changes expression. The eyes are then glued into the bottom of the three holes. The three doll's eyes lie flush with the bottom of the three drilled holes located ¼" from top edge of checker and ⅛" centered below first two holes. Each eye ¼" has dome eyeball (32) and moveable pupil (36). There are five dark (12) triple-indicator checkers (40) and five light (16) triple-indicator checkers (40)—one set for each player.

Ramifications of the single, dual, and triple-indicator checker bottoms (4, 28, 40) could include painting the eyes on the bottom of the checkers; placing printed faces representative of player movement on the bottom of the checkers; non-moveable doll's eyes affixed to the holes in the bottom of checker; eye indicators could change size to suite design or facial figures to reflect positive or negative moods of the indicator; different geometrical configurations; numerical variables being substituted for the eyes.

OPERATION—FIGS. 4-6

Chancing Checkers is a game of competition and skill coupled with the excitement of chance as an equalizer. This game is best played by standard checker rules as redefined below. The objective of Chancing Checkers is to capture all of the opponents checkers. This is accomplished in one of two ways: by blocking opponents forward movement, or by removing opponents men from the playing field by jumping (also known as capturing).

Two players, each positioning 12 of the 15 like colored checkers (12 or 16) on 3 rows of the dark colored squares (48) at opposite ends of the checkerboard (44). The remaining three checkers (12 and 16) from each player's draw remain at the side of the checkerboard to draw from when crowning a king (see FIG. 4).

Five checkers have single-indicator bottom (4), meaning lose your turn, thus return the jumping checker to its starting place before the jump (see FIG. 5, single-indicator checker). Five checkers have dual-indicator bottoms (28), meaning play normally; thus, remove the jumped checker from the playing board (see FIG. 5, dual-indicator checker). Five checkers have triple-indicator bottoms (40), meaning reverse action; thus, remove the jumping checker from the checkerboard (see FIG. 5, triple-indicator checker).

Alternating turns are taken by both players to advance the checker diagonally forward one square at a time (see FIG. 4), trying to avoid capture by opponent until reaching opposite end of playing field where the king's crowning takes place on arrival. It is important to note that throughout the game the indicators remain face down and unseen until a jump is made (see FIGS. 4–6). After the jump, turn over the jumping checker for the opposing player to see and follow the rules according to single, dual, or triple-indicator.

Capturing the opponent's checkers consists of removing the opponent's checkers from the checkerboard (44) after jumping to an unoccupied dark (48) colored square diagonally as many times as desired or as space allows (see FIG. 5 for illustrations of single jumps or double jumps.) Each captured checker is to be added to the side of the checkerboard of the corresponding color and shuffled each time before one is chosen out to crown a king. Taking jumps is optional.

Crowning consists of placing an existing checker on top of an existing checker of the same color which has reached the opponent's first dark checkerboard square (48). The checkers on the side of the checkerboard (44) are shuffled, and one is chosen face down and placed on top of the existing checker. Neither player knows the status of single, dual, or triple-indicator. The top checker of a crowned 'king' is the one which determines the capture of the opponent's checkers (see FIG. 6). This enables the new 'king' to move about one square at a time diagonally and capture the opponent's checkers if the indicator allows. When both opponents movement and men are removed from the playing field, the remaining color is declared as 'winner,' thus ending the game. In a series of games, the kinged checkers left on the board count ten points and the single checkers left on the checkerboard count three points. The player having the most points wins the game.

Ramifications of the game rules include a slight variation of the original game rules. Each player shuffles the prospective checkers (dark or light). Twelve checkers are picked, leaving three at the side of the checkerboard. Each player looks at the checkers before choosing and is allowed to place the chosen checkers face down on the checkerboard, according to each player's preference. This gives both players an advantage in the strategic placement of the 12 checkers on the checkerboard without the opponent's knowledge, thus creating the element of 'bluffing' the opponent with certain moves. This variation adds more challenge to the game and presents the same excitement. For instance, a player can deliberately move a useless checker (single-indicator) in front of the opponent and tempt the opponent to jump, hoping that the opponent's checker is a triple-indicator. Thus, the opponent would lose the checker. When jumps are made, both players still look at the bottom of the checker. There is still random drawing for 'kinging' a checker. However, the person choosing the checker can look at the checker bottom before placing it. If it is a single-indicator or triple-indicator, the player can 'bluff' the opponent with strategic moves.

SUMMARY, RAMIFICATIONS, AND SCOPE

Accordingly, the reader will see that the single, dual, and triple-indicators on the checker bottoms completely change the ordinary checker game into an innovative, creative, and thought-provoking game which drives both young and old to strive to win 'in a race to the finish.' Furthermore, my game, Chancing Checkers, has the additional advantages in that

- the game pieces and rules can be used with the original checkerboard, thus making production of this game economical.
- the single, dual, or triple indicators are easily drilled, allowing easy access to fit and glue the doll's eyes into the bottom of the checker.
- the single, dual, and triple-indicators can be sent without a checkerboard if the purchaser request it, thus decreasing the cost to purchaser.
- due to the lightweight material used in manufacture, shipping cost would be minimal.
- simple directions with illustrations of the checker bottoms and corresponding movements of checkers allow both children and adults to play.
- this game provides a challenging and innovative game to promote more interest and memory exercise beyond other modified checker games.
- my game combines competition and skill, coupled with the excitement of chance as an equalizer.
- the name 'Chancing Checkers' gives both players the illusion of chance and competition.
- the eye-catching checker apparatus sparks great interest in a relatively simple and familiar game for both adults and children.
- the single, dual, or triple apparatus provides a feeling of 'eyes' looking at the player when picked up to jump opponent.
- my game builds memory skill and strategic thinking processes which in turn create 'fun' educational value for children.
- the option of black and white checkerboard gives the players feelings of a 'race to the finish,' as in a car race.
- my game offers the challenge of shuffling and randomly selecting 12 out of 15 checkers by each player without either player knowing the type of checker bottom (single, dual, triple-indicator).
- my game creates more mystery when a checker is 'kinged,' as the checker chosen to king with is randomly selected, as well.
- both players see the bottom of the jumping checker and both players know what kind of play it can or cannot make, thus providing memory skill and strategic manipulation to improve the challenge and competition of the game.
- the 'anticipated' winning player can suddenly lose in the last moments of the game by having the wrong 'kinged' checker on top or the wrong 'single' checkers remaining on the board.

Although the description above contains many specifications, these should not be construed as limiting the scope of the invention, but as merely providing illustrations of some of the presently preferred embodiments of this invention. For example, the game can be played on a black and white checkerboard, a dark and light checkerboard, a dark and dark checkerboard using different colors, or light and light checkerboard using different colors. Likewise, the single, dual, and triple-indicator checkers can be black and white, dark and light, dark and dark, or light and light. The checker apparatus can also be made of wood, plastic, or molded resin. The design on top of the checker can represent Chancing Checkers (CC), be a king's crown, have a question mark, or have a questioning face. The checker bottom can have the round moveable eyes, as shown; have painted eyes; have printed faces representative of player movement; have non-moveable doll's eyes; have other eyes besides doll's eyes; have different sizes; have different geometric configurations; have numerical variables substituting for the moveable eyes.

Ramifications of the rules could include, allowing each player to look at the checkers before choosing them; allowing placement of said checkers face down on the checkerboard without the opponent's knowledge, thus creating the element of 'bluffing' the opponent with certain moves.

Thus, the scope of the invention should be determined by the appended claims and their legal equivalents, rather than by the examples given.

I claim:

1. A game, comprising:

a playing surface;

a plurality of playing pieces, each of said playing pieces having a first face and a second face, said second faces being structured and arranged to contact said playing surface; and at least some of said playing pieces having one or more eyes located within said respective second face, with each of said eyes comprising a dome eyeball with a movable pupil located within said dome eyeball.

2. The game of claim 1 wherein said respective dome eyeballs are set into said respective playing pieces and are flush with said respective second faces.

3. The game of claim 1 wherein said plurality of playing pieces comprise a first set of playing pieces, a second set of playing pieces and a third set of playing pieces, said playing pieces of said first set of playing pieces each having one of said eyes, said playing pieces of said second set of playing pieces each having two of said eyes, said playing pieces of said third set of playing pieces each having three of said eyes.

4. The game playing apparatus of claim 1, wherein:

said playing surface is divided into eight columns and eight rows;

each of said first, second and third sets of playing pieces has five playing pieces such that there are five of said playing pieces having one eye unit, five of said playing pieces having two eye units, and five of said playing pieces having three eye units.

5. A game playing method comprising the steps of:

providing a game playing board having a playing field located thereon;

providing two sets of checker pieces, at least some of said checker pieces having a code located thereon, said code being provided by a first, second or third type indicator;

locating said checker pieces on said playing field of said game board so that said code on each of said checker pieces is hidden from view by human players;

jumping a checker piece of one set of checker pieces over an opposing checker piece of the other set of checker pieces on said playing field of said game board, said checker piece that is jumping being a jumping checker piece;

determining if said jumping checker piece has said first, second, or third type indicator located thereon;

moving said jumping checker piece and said opposing checker piece according to said indicator type on said jumping checker piece, wherein said jumping checker piece is returned to its initial position on said game board and a player moving said jumping checker loses a turn if said jumping checker piece has said first type indicator; said jumping checker piece is jumped over said opposing checker piece on said game board and said opposing checker piece is removed from said game board if said jumping checker piece has said second type indicator; said jumping checker piece is removed from said game board if said jumping checker piece has said third type indicator.

6. The game playing method of claim 5, further comprising the steps of:

locating each of said sets of checker pieces on opposing ends of said playing field of said game playing board;

moving one or more of said checker pieces of each set towards said respective opposing ends of said playing field of said game playing board in alternating turns;

crowning a checker piece of a set when said checker piece has reached said respective opposing end with a crowning checker piece of the same set selected from a plurality of checker pieces of said set located off of said game playing board, wherein said crowning checker piece is located on said crowned checker piece so that said code of said crowning checker piece is hidden;

moving said crowned checker piece and said crowning checker piece together on said playing field;

jumping an opposing checker piece with said crowned and crowning checker pieces;

determining if said crowning checker piece has said first, second, or third type indicator located thereon;

moving said jumping crowned and crowning checker pieces and said opposing checker piece according to said indicator type on said crowning checker piece, wherein said jumping crowned and crowning checker pieces are returned to their initial position on said game playing board if said crowning checker piece has said first type indicator, and a player moving said jumping crowned and crowning checker pieces is to lose a turn; said jumping crowned and crowning checker pieces are jumped over said opposing checker piece and said opposing checker piece is removed from said game board if said crowning piece has said second type indicator; said crowning and crowned checker pieces are removed from said game board if said crowning checker piece has said third type indicator.

7. The game playing method of claim 6, further comprising the steps of:

before locating said checker pieces from said sets of checker pieces on said playing field of said game board, selecting a set of checker pieces;

before locating said checker pieces from said sets of checker pieces on said playing field of said game board, determining said codes of said checker pieces, wherein said checker pieces can be strategically placed.

* * * * *